United States Patent [19]

Ryer, II

[11] Patent Number: 4,480,433

[45] Date of Patent: Nov. 6, 1984

[54] ROTOR CLEANING

[75] Inventor: Richard N. Ryer, II, Cleveland, S.C.

[73] Assignee: Platt Saco Lowell Corporation, Greenville, S.C.

[21] Appl. No.: 469,877

[22] Filed: Feb. 25, 1983

[51] Int. Cl.[3] ..... D01H 7/885

[52] U.S. Cl. ..... 57/302; 15/21 R; 15/56

[58] Field of Search ..... 57/302, 301, 304, 404, 57/414, 415; 15/301, 304, 21 R–21 E, 56–59, 70

[56] References Cited

U.S. PATENT DOCUMENTS

| | | | |
|---|---|---|---|
| 3,662,532 | 5/1972 | Stahlecker | 57/302 X |
| 4,125,991 | 11/1978 | Stahlecker | 57/302 |
| 4,135,354 | 1/1979 | Stahlecker | 57/302 |
| 4,155,217 | 5/1979 | Stahlecker | 57/302 |

*Primary Examiner*—John Petrakes
*Attorney, Agent, or Firm*—Donald H. Feldman

[57] ABSTRACT

Means and method are disclosed to clean the fiber collection groove of an open end rotor's cup by use of a flexible member rotated about the groove and counter-rotated in the opposite rotational sense, it being the changeovers or reversals in rotational directions which apply through the tip of the flexible member the cleaning force at the points of changeover at the groove which effect the cleaning of accumulations of foreign matter. These changeovers are effected by changing relative rotation and counter rotation between the rotor cup and the flexible end member, and are controlled by a programmable control means which may include a microprocessor working through one or more motors, one of which may be a stepped motor of high torque values and occupying but little space.

9 Claims, 7 Drawing Figures

ROTOR CLEANING

BACKGROUND OF THE INVENTION

Rotors of open end spinning machines are formed with an internal concentric peripheral groove of critical dimensions, there to receive discrete fibers in an overlaying pattern and permit them to twist into a yarn end to then be withdrawn from the rotor as a continuous yarn strand of a desired cross-sectional dimension and uniformity from length portion to length portion therealong.

However, minute particles of foreign matter carried along with the fibers received by the groove in time build up therewithin to change the geometry of the groove in an unequal fashion thereabout to change the characteristics of the yarn formed, and ultimately to produce so weak a yarn that it easily parts, producing what is known as an ends down condition. In common mill practice, it has been found desirable to remove the accretions of foreign matter from the rotor cup grooves in a timely manner prior to a serious deterioration of yarn characteristics. To do this, many techniques have been tried. For example, in some mills after a predetermined running time the spinning operator will move along the row of rotors, stopping each in turn, opening the rotor box, removing the fibers within, digging out the fiber collection groove, closing the box, and restarting the fiber feed and rotor cup rotation, and then feeding back the free end of yarn to make contact with the circlet of fibers for their twisting in, and finally pulling out the newly forming strand of yarn to wind it into a "cheese" in a resumption of production of yarn at that spinning station. Such is manual rotor cleaning and repiecing of the yarn. This process is followed also whenever during production the yarn end "comes down," which is to say that separation occurs between the fiber circlet and the yarn end or between two portions of the yarn between where it leaves the rotor and is wrapped onto the package being formed. If ever the rotor is stopped, such as at the end of some shift perhaps, or if the package is manually doffed perhaps, rotor cleaning and repiecing are pursued, often as a prudent measure to help insure the quality of yarn following these events.

Technologists in the art of rotor cup yarn spinning have solved many of the problems involved in devising apparatus for the mechanical repiecing of yarn and the doffing of cheeses of yarn from and donning tubes onto the machine. However one problem has been unusally resistant to a satisfactory resolution: that of adequate cleaning of rotors' grooves to free them of all foreign matter by mechanical means, and all the while not injuring the groove surfaces or changing their geometries. This problem is better understood with the consideration that the foreign matter particles accreting with processing time, under the heat developed in the rotor and in the presence of resins perhaps on natural fibers and in the form of dressings on synthetic fibers, tenaciously seem to bind themselves both to the metal surfaces of the groove and to one another. In manual cleaning, experienced operators often use wooden "toothpicks" to dig out the accumulations of foreign matter, the wood being soft enough not to injure the metal surfaces of the grooves and being inexpensive enough to use many such wooden "picks" for cleaning at little material cost but at a larger labor cost. They found that yarn produced shortly after cleaning in the foregoing manner was restored to the desired tensile strength and cross-sectional diameter with a strongly improved uniformity in those regards from length portion to length portion therealong. One way to date has been proposed whereby literal "toothpick" cleaning of the collection grooves or rotors may be done mechanically, which is to say by a machine "picking" without human intervention; however even this apparatus falls short of attaining a "toothpick clean" groove. By "toothpick clean" is meant not necessarily that toothpicks must be used, but rather that the degree of cleaning, lack of injury to the surfaces and geometries of the grooves, and the desired restoration of yarn properties be attained in a comparable or better extent as or than can be done by the manual "toothpick" method. Motorized brushes moving even at hundreds of revolutions per minute, motorized plastic scoops with serrated wheel rims have been tried, vacuum nozzles have been employed, and yet, to present knowledge until the advent of the present invention, none have cleaned toothpick clean, producing in essence a bright or burnished clean metal surface at the apex of the collection groove, without damage or change in geometries.

SUMMARY OF THE INVENTION

This invention includes means and method for cleaning the fiber collection groove of the spinning rotor of an open end yarn spinning machine toothpick clean employing rotatable and flexible burnishing toothpick clean means having preferably a plurality of end portions of sufficient length and contour so as to extend into the collection groove of a rotor to the apex thereof and beyond, and of sufficient flexibility so as to be resiliently flexed upon contacting the apex, means for moving the flexible burnishing means into the cup of the rotor and withdrawing it therefrom, means for rotating and counterrotating the flexible burnishing means and means for controlling the movement of the flexible burnishing means into and out of the cup and in rotation and counterrotation in accordance with a predetermined sequence of operations found to be efficacious in cleaning the particular collection groove of a particular rotor yarn spinning cup. In the present method, the burnishing means is moved into the stopped rotor cup to a predetermined distance from the apex of the fiber collection groove, while rotating in a given orientation. Upon attaining that distance, a plurality of the flexible end portions of the burnishing means are in contact with the apex of the fiber collection groove of the rotor cup and rotate thereabout. Further, the control means thereupon causes the rotating and counterrotating means to rotate and counterrotate the burnishing means and its flexible end portions, changing the direction of rotational orientation a plurality of times in any one circumnavigation of the collection groove by any one of the flexible end portions of the burnishing means, from let us say rotation to counterrotation and then counterrotation then to rotation, for example as clockwise to counterclockwise and counterclockwise to clockwise when viewed end-on, or vice versa. Following a prescribed number of circumnavigations, the burnishing means is withdrawn from the cup, leaving a cleaned and burnished collection groove.

OBJECTS OF THE INVENTION

It is an object of the invention to provide means and method for cleaning the fiber collection groove of a stopped rotor cup, used in the open end spinning of staple fiber yarn, such as textile yarn, removing thereby substantially all observable foreign matter from the apex of the groove.

Another object is to provide such a means and method which effect cleaning without perceptible injury to the surfaces of the collection groove or perceptible change in the geometries and dimensions of such surfaces.

A further object is to provide such a means and method which may be employed without the need for human intervention, and are capable of being made part of an automatic mechanical sequencing of yarn end piercing and or package doffing and tube replacement in the production of yarns.

DESCRIPTION OF THE DRAWINGS

These and other desirable objects of the invention are attained as more fully set forth in the following explanations and claims, when taken in conjunction with the appended drawings in which:

PREFERRED EMBODIMENTS OF THE INVENTION

Figure 1:
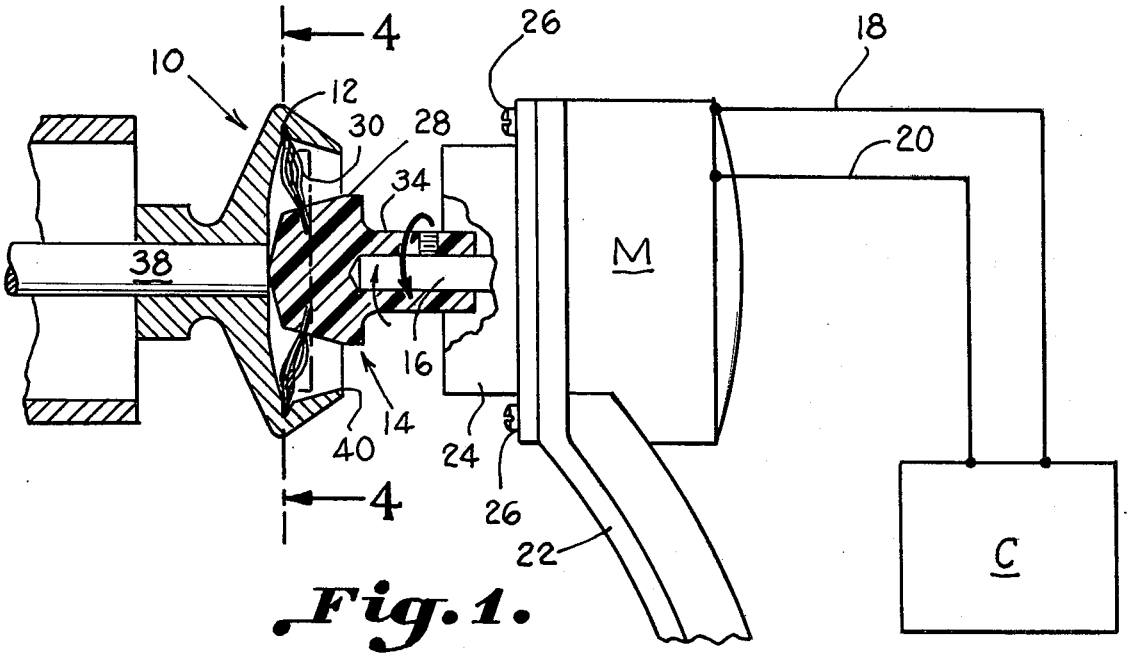
FIG. 1 is a fragmentary view partially diagramatic and partially in section showing the sundry means of the invention in the process of cleaning the collection groove of a stopped spinning rotor, when seen in side elevation.

Referring to the drawings, a rotor cup 10 is shown, having been formed with an internal concentric, peripheral groove 12 of critical geometry and dimensions to receive therein during cup 10 rotation discrete fibers (not shown) which orient themselves in groove 12 and to twist into a yarn thereafter upon withdrawal from cup 10. Whenever yarn formation is interrupted, before it may be resumed cup 10 and its groove 12 must be cleared of fibers and any foreign matter therein. Fibers may be removed by vacuum, for example, but the adhering foreign matter particles resist such, and coat the collection groove. To remove the latter, means and process of this invention are employed.

In this preferred embodiment, the rotatable and flexible burnishing means is in the form of a brush, generally designated 14, and is shown in FIG. 1 to be mechanically interconnected through a shaft 16 to a driving motor M, which motor M in turn is operatively interconnected with a source of power and control means diagrammatically indicated as C. As seen, motor M is a reversible motor, being capable of rotating brush 14 in an anticlockwise direction, as shown by the heavy arrow thereafter, and also in a clockwise direction, as indicated by the smaller and lighter arrow thereabout. Motor M in this embodiment is a somewhat more specialized type known to the art as a "stepping motor." The advantages of use of a "stepping motor" M as part of the present means for rotating and counterrotating the brush 14 will be explained further later. Interconnections between source of power and control means C and motor M are diagrammatically indicated by electrical cables 18 and 20, which may be flexible and of substantial length. The nature and construction of power source and control means C may be of any of the varieties and types presently known in the art to provide power and impart control over the operation of motor M to effect the various steps pursued in the method of the present invention. These may include programmable microprocessors, for example.

Motor M and interconnected brush 14 are moveable into and out of rotor cup 10 by interconnection with the present means for such moving including an arm 22, but otherwise not shown, to which arm 22 motor M and brush 14 are fixed such as by screws 26; also fixed to arm 22 is a plenum 24 which may intercommunicate with some source of pressurized gas (not shown) such as air, a blast from which during or following the present cleaning process may assist in suspending fibers and loosened foreign matter, these then to be removed from cup 10 as trash by the normal vacuum or under pressure conventinally applied to cup 10 during yarn formation. This moving means may derive its motive power from some other motor (not shown) which may even be the motor driving the spinning frame through interconnections (not shown) such as clutchings or the like, and this moving means may be under the control of control means C through other electrical interconnections (also not shown).

Figure 5:
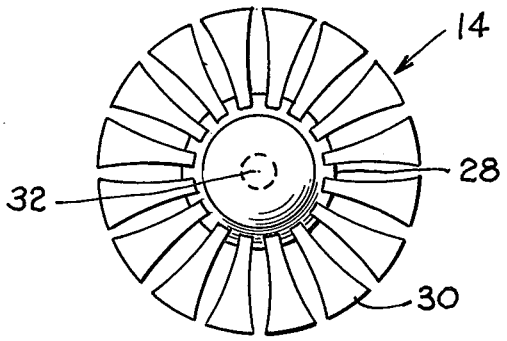
FIG. 5 shows in plan view another embodiment of the present burnishing means wherein the end portions are resiliently flexible flat members such as may be formed from some suitable rubber or plastic with the desired combination of properties of rigidity, resiliency and hardness (or softness)
Figure 6:
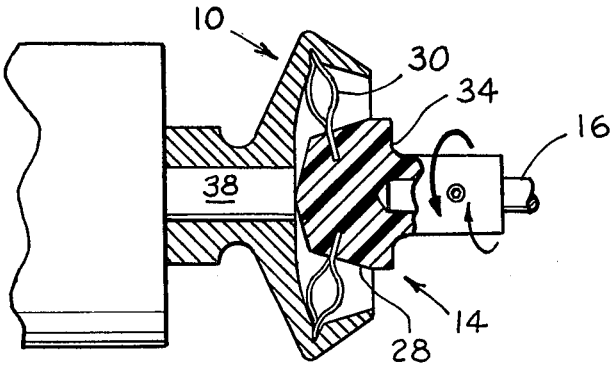
FIG. 6, in similar view to FIG. 1, shows the burnishing means of FIG. 5 in the process of cleaning the collection groove of the rotor cup.

Flexible burnishing or cleaning means 14 is shown to comprise a shank portion 16, a holder or body portion 28 for holding a plurality of flexibly resilient end portions 30, shown as bristles in FIGS. 1 through 4B and as resiliently flexible and relatively flat end members which may be formed of a rubbery plastic, for example, in FIGS. 5 and 6, and a shaped, conical-like end abutting portion 32 which abuts the inner back of cup 10 to provide proper positioning of means 14 for pursuing the present cleaning process which now shall be described.

Figure 2:
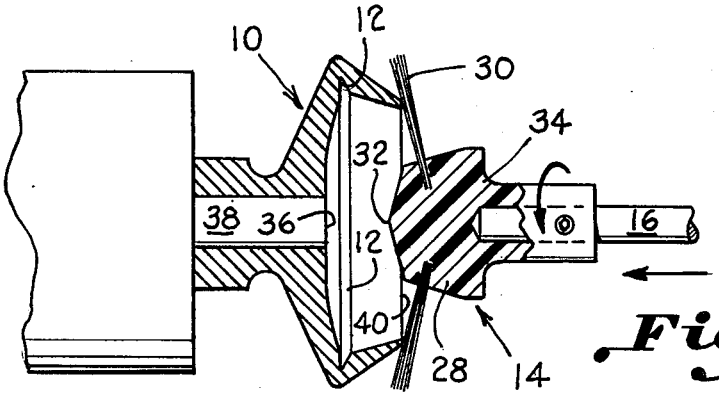
FIG. 2 is a view similar to that of FIG. 1 showing however the burnishing means in the form of a bristled, motorized brush just prior to its entering the rotor cup.

Upon signal from control means C, moving means for brush 14 moves arms 22 and with it motor M and brush 14 toward the opening in rotor cup 10, as best shown in FIG. 2. As is shown, and depending upon the particular orientation of the flexible end members 30 relative to their points of attachment to holder 28, including their angle to the axis of rotation of brush 14, as brush 14 enters the orifice of rotor cup 10, end members 30 may overextend the rim portion 40 of cup 10 (FIG. 2). To facilitate entry of the end portions 30 into cup 10 it has been found expedient to rotate brush 14 during entry movement. Further, it is clearly seen from FIG. 2 that end portion members 30 are of such length, when full entry is subsequently made, to extend to the apex of collection groove 12 and beyond, were the latter possible. As brush 14 further enters rotor cup 10, at least some of the plurality of flexible end members 30 have reached and are essentially contained by the apex of collection groove 12 (FIG. 3), in a flexed condition. This also is seen in FIGS. 1 and 6, where the brush has attained a predetermined distance from the apex of collection groove 12.

Rotor cup 10 is fixed for rotation upon a drive shaft 38, the end 36 of which forms a portion of the bottom or back of cup 10. As previously mentioned, shaft 38 is braked or fixed so as to prevent cup 10 from moving, end 36 of which is of hardened steel, while the remainder of cup 10 may be of another metal such as some aluminum alloy which is commonly used to form rotor cups. The shank 34, body portion 28 and end abutting portion 32 as shown in FIGS. 1 to 4B and 6 may be formed integrally from some suitable structural plastic, providing for the purposes herein and the proper functioning of the burnishing means a bearing surface at end abutting portion 32 of brush 14. Thus, as seen from FIGS. 1 and 6, when control means C stops the inward movement of brush 14 at the time that hardened cup and drive shaft end 36 is abutted by the end abutting portion 32 of brush 14, a fixed relationship is attained between where bristles 30 leave the body portion 28 of brush 14 and the apex of collection groove 12. This distance is such that bristles 30 not only reach the farthermost points of that groove 12 apex, but are yet longer and therefore must flex and bend exterior the groove; by their nature, the flexible end members 30 bend resiliently, which is to say "flex", imparting to those portions of the metal surfaces onto which the ultimate ends or tips of members 30 make contact a force in accordance with Young's modulus of elasticity for the particular materials of which members 30 are composed, and the degree of bending incurred, as well as the surface area of each member 30 making contact. Thus, one may readily see that in the instance where members 30 are bristles, for one thing each bristle tip end making contact would exert a substantial force on the groove surface because whatever that force may be it is exerted on but an almost minute surface area, as in FIGS. 1, 3, 4A and 4B; however should the same force per member 30 be exerted by a member 30 as in FIGS. 5 and 6, the force per unit area of surface applied would be substantially less. In the latter instance, therefore, should it prove necessary to have applied a force per unit area (surface pressure) beyond what was considered with the FIGS. 5 and 6 flexible end member 30 embodiment, one would (should such an embodiment be desired) reformulate according to the known art a rubber member 30 of a higher Young'd modulus. This usually means that the member 30 would be somewhat stiffer or appear so, but not so stiff as to frustrate the cleaning process of the invention or a desired long useful life of service of the present burnishing means, or of cup 10 and groove 12.

Figure 3:
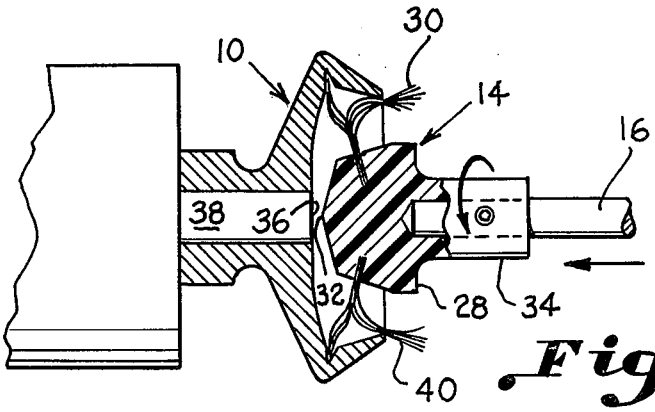
FIG. 3 is similar to the view in FIG. 2 showing the bristled brush after it has entered the rotor cup but prior to its stop at the desired predetermined distance from the the apex of the collection groove of the rotor cup.
Figure 4A:
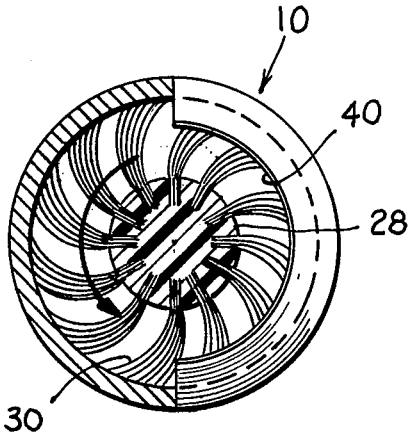
FIG. 4A is a sectional view of the present burnishing means and rotor of FIG. 1 when taken along the line 4—4 of that figure, showing the bristled brush embodiment set at the predetermined distance from the accretion or collection groove of the cup and in rotation thereabout in an anti- or counterclockwise direction with the bristles ends contained by the groove at the apex thereof and the center portion of the bristles flexed in a brushing mode.
Figure 4B:
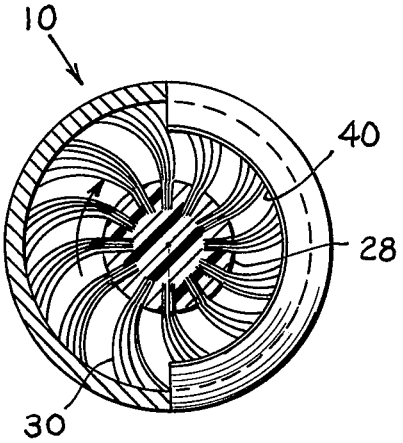
FIG. 4B is of the same view as that of FIG. 4A, showing however the burnishing means bristled brush rotated in a clockwise direction following a change in rotational direction or sense of motor M of FIG. 1, with the bristles flexed in that changed direction with their ends contained by the groove and moving along the apex thereof.

In the approach of flexible burnishing means 14 toward and into rotor cup 10, means 14 may be rotated in one direction to facilitate entry of members 30 into cup 10, as shown in FIGS. 2 and 3; this would be used if end members 30 overextended rim 40. Alternately, in such an instance, should it be found desirable both rotation and counterrotation may be used. If members 30 in their approach to rim 40 of cup 10 do not overextend the rim but are set at such an angle so as to pass without impedance into cup 10, then no rotation of means 14 may be needed at all.

At any event, by whatever approach technique may be employed, by the time that means 14 has attained its predetermined distance from the apex of groove 12 at least a plurality of members 30 are contained within rotor cup 10 with their ultimate tips in contact with the surfaces of groove 12 and its apex, and their extention from the tips in a flexed state, as seen in FIGS. 1, 3, 4A, 4B and 6, exterior groove 12. Then control means C causes motor M to rotate and counter-rotate burnishing means 14 according to a predetermined manner. Within a very short time interval, should there be any members outside of cup 10 or any of their ultimate tips as yet not contained within groove 12 and in contact with its walls and apex, it has been found that this rotation and counterrotation has the effect of bringing all such members 30 within cup 10 and their ultimate tips within groove 12 and in contact with its surfaces and apex. However, rotation and counterrotation play a vital role beyond this in the present cleaning process, and more particularly the changeovers in directions from one rotational sense to the other.

Upon a change of rotational sense from rotation to counterrotation and vice versa, members 30 also are forced to changeover the directions of flexure or bending. Although the exact mechanism of cleaning exacted by the aforesaid "changeovers" in rotational sense or direction is not completely understood at this time, it is known according to this invention that such changeovers are critical to its effective working. It is presently believed that upon each changeover in rotational sense from say clockwise to anticlockwise, a rather sudden changeover also occurs in the flexure bending of members 30. Such changeover causes also a rather sudden change at the least in the contact angle of the ultimate tips of members 30 with the surfaces and apex of groove 12, and in so doing impact the surfaces and apex with a force much exceeding that ordinarily applied in the course of ordinary rotation between such changeovers, such as the force called "stretch force" due to bending of members 30. It is these sudden impacts, it is believed, which dislodge adhering fibers and foreign matter from groove 12 surfaces and apex, and which thus clean these to a bright or burnished condition. Nevertheless, by whatever the exact mechanism may be through and by which the present invention works, it was discovered that the present process requires changes in rotational sense to occur, and with some frequency, between the surfaces of rotor 10 to be cleaned and the present cleaning means 14.

Following some prescribed time interval during which some prescribed rotational changeovers in direction are caused by the present invention, or after a prescribed number of circumnavigations of the groove 12 by members 30 during which the aforesaid changeovers occur, these being determined by experience, means 14 is withdrawn from cup 10 by arm 22 and its moving means under the control of control means C, and is restored to some "rest" position out of the way of the spinning mechanisms (not shown) to await its next operational sequence at another rotor box or cup 10 requiring cleaning.

In order that no injury of the surfaces and apex of groove 12 be incurred, such as by scratching or undue wear which would significantly change the dimensions and geometries of the surfaces of groove 12, one skilled in the art would select carefully the materials used to form the flexible end members 30, whether bristles as in FIGS. 1 through 4B, or flat members 30 as in FIGS. 5 and 6, or of another design or configuration, making sure that, on say the Mohr scale of hardnesses, the members 30 had a somewhat lower hardness than the surfaces of cup 10 to be cleaned. Thus, if the groove 12 is of an aluminum alloy, one would not choose bristles 30 as in FIG. 1 which were of spring steel; rather one may choose bristles 30 of some appropriate nylon polymer composition.

After flexible burnishing means 14 is withdrawn, the cover (not shown) for cup 10 is replaced restoring to cup 10 an operational sub-atmospheric pressure (vacuum) and in so doing sweeping the air containing suspended therein fibers and the freed foreign matter, out of cup 10 prior to once again receiving a feed of new discrete fibers and their twisting into a yarn for resumptionof yarn production.

The use of a "stepping" motor as motor M of FIG. 1 greatly simplifies effecting a programmed and predeterminedly effective number of reversals or rotational "changeovers" in rotational direction of means 14 for utility in the present process, and is a preferred motor M in its practice. Thus, in use of the "stepping" motor M, rotation of means 14 within cup 10 would advance a certain specified number of degrees, let us say X°, before a reversal or changeover in rotational direction specified by control means C would occur. Then upon such reversal, the sense of flexure bending of members 30 also would reverse, causing the beneficial cleaning effect previously described as occuring at the time of reversal. This is then followed by the counterrotational movement of members 30 in groove 12 for another and different predetermined number of degrees Y° which are less than the X° of rotation by a certain predetermined amount, say y°. Upon completion of counter rotation of members 30 the defined Y°, once again motor M as controlled by control means C changes rotational sense of cleaning means 14 to the "rotational" sense first mentioned, completing as it were one cycle of movements and reversals, leaving members 30 displaced from their initial position at the beginning of the cycle some y° degrees further down or along groove 12. If one circumnavigation of groove 12 by members 30 of 360° required some multiple N of y°, by the preceding program of advancements, reversals, counterrotations and reversals, i.e. $360° = N \times y°$, and for a thorough cleaning of groove 12 with the particular embodiment of means 14 it would require as experience shows a minimum of some K number of circumnavigations according to the above described program, one is enabled to program control means C for specific values of advancement X° and counterrotation of Y° merely knowing the number of reversals, i.e. 2 times N, desired for one circumnavigation and also the K number of circumnavigations desired for effective cleaning in any embodiment of cup 10, groove 12 and cleaning means 14. Actual programming of control means C may be somewhat more complex whenever it is desired that reversals during successive circumnavigations be displaced along groove 12 from those of previous circumnavigations, so that indeed in any given interval designated for a complete cleaning of repetitive cycles a maximum number of locations along groove 12 may endure and be the locus of rotational reversals. In effecting such a desired result, use of the stepping-type motor for motor M is particularly felicitous because of its very high torque characteristics. Thus, when using a stepping motor M, when control means C directs a change in rotational sense of motor M and cleaning means 14, there occurs an almost instantaneous response in changeover of rotational direction and flexure of members 30, providing in effect maximum force applied to the then surfaces of groove 12 engaged by the ultimate ends or tips of members 30, within a minute time interval. This it is found appears to provide a maximum cleaning effect, and may beneficially reduce to the minimum the number of circumnavigations K required to complete cleaning groove 12.

While a presently preferred embodiment of the invention has been set forth in some detail, it will readily be appreciated by one of ordinary skill in the art that for any particular set of circumstances and operational conditions, adaptations may readily be made to effect efficacious variations from what has been described. For example, it is within the ken of this invention that where indicated it may prove desirable to employ but a single flexible member 30 instead of a plurality, wherein such member 30 may be resilient of itself for example or in the alternative may be rigid but may be resiliently and flexibly mounted so that its sense of flexure or bending may be changed as previously described by changeover in rotational sense to provide the impact application of cleaning force thereupon. Further, it is presently contemplated that should it prove desirable, the relative rotation between cup 10 and cleaning means 14 may be effected in a way other than that set forth in the preferred example. For instance, the concept of the present invention would not be compromised irrevocably should it be found desirable to permit motor M to rotate, and then counter rotate cup 10 rather than means 14, keeping means 14 stopped; yet further, it also is within present scope of the invention to employ a plurality of motors M controlled by means C, one ot rotate cup 10 while another counter rotates means 14 or even have one rotate cup 10 and another rotate means 14 but at a different rate from that of cup 10, so as all in all, regardless of the approaches, to provide for relative rotation between cup 10 and means 14. But, of course, now all of the foregoing almost immediately come to mind to one of skill in this art to provide a proper adaptation to effect the here desired and effected cleaning regardless of the particular circumstances and peculiarities of construction and operation of the rotor spinning frames involved or the yarn produced thereby, from whatever stock at whatever level of trash content it may have.

Of special promise is the application of the present invention to use with a mobile carriage either independently of or in concert with a yarn piecing or bobbin tube doffing and donning device, or other carriage borne servicing means. This can obviate special design modifications of a rotor spinning frame as in retrofitting or new construction, and thus impart substantial economies and a wider usage in application of the present effective cleaning means to extant rotor spinning frames of diverse makes and vintages.

I claim:

1. Apparatus for cleaning the fiber collection groove in the cup of a yarn spinning rotor use in an open end spinning machine, comprising:

a. cleaning means comprising a resiliently flexible end member of sufficient length so as to reach and overextend the apex of said collection groove, when said means is set at a predetermined distance position within said rotor's cup, such that said member flexes in resilient bending when its tip is contained by said groove, said means further comprising a body holding portion for holding said end member in an extended condition therefrom;

b. means for providing relative rotation, counter rotation, and changeovers in rotational sense between said rotor's cup and said flexible end member;

c. means for moving said flexible end member into and out of said rotor's cup; and d. control means for establishing a predetermined sequence of movements, changes of movements, and stoppages of movements of said rotor's cup and said flexible end member, and for controlling said movements, changes of movements and stoppages of movements in accordance with said established and predetermined sequence to effect said cleaning means to clean said collection groove, said control means being interconnected with said means for providing and said means for moving.

2. Apparatus according to claim 1, wherein said end member is a bristle.

3. Apparatus according to claim 1, wherein said end member is non-metallic.

4. Apparatus as in claim 1, wherein said cleaning means further comprises an end abutting portion means for abutting said cup therewithin to set said predetermined distance position between said cleaning means and said collection groove.

5. Apparatus according to claim 1, wherein said means for providing relative rotation, counter rotation and changeovers in a rotational sense is an electrical motor.

6. Apparatus according to claim 5, wherein said motor is a stepping motor.

7. Apparatus according to claim 2, wherein said end member is a plurality of end members, and such end members are bristles.

8. Apparatus according to claim 7, wherein said cleaning means is in the form of a brush.

9. A process for cleaning the fiber collection groove in a cup of a yarn spinning rotor used in an open end spinning machine, employing the apparatus as defined in claim 1, comprising the steps of a. moving the cleaning means of said apparatus into said cup and fixing one so that it does not move after attaining a predetermined position of one relative the other such that the resiliently flexible end member reaches and overextends to the apex of said groove, and its tip is contained by said groove such that it flexes in resilient bending;

b. effecting relative rotation of said end member with said cup a prescribed number of degrees, then counter rotating the one relative the other in an opposite rotational sense a different prescribed number of degrees, whereby upon the changeover from rotation to relative counter rotation, the flexible end member while in rotation moving along said groove with said tip directed away from the direction of rotation and the felxible member resiliently bent in the direction of rotation, both the direction of the tip and the direction of bending are reversed, and then again after a prescribed number of degrees of counterrotation are attained causing another changeover from counter rotation to rotation to form one cycle of events;

c. repeating said cycle of events a predetermined number of times as experience shows will effect the cleaning desired; and d. moving said cleaning means out of said cup.

* * * * *